US005987142A

United States Patent [19]

Courneau et al.

[11] Patent Number: 5,987,142

[45] Date of Patent: Nov. 16, 1999

[54] SYSTEM OF SOUND SPATIALIZATION AND METHOD PERSONALIZATION FOR THE IMPLEMENTATION THEREOF

[75] Inventors: Maîté Courneau, Merignac; Christian Gulli, St Medard en Jalles; Gérard Reynaud, Begles, all of France

[73] Assignee: Sextant Avionique, Velizy Villacoublay, France

[21] Appl. No.: 08/797,212

[22] Filed: Feb. 11, 1997

[30] Foreign Application Priority Data

Feb. 13, 1996 [FR] France ..... 96-01740

[51] Int. Cl.[6] ..... H04R 5/00

[52] U.S. Cl. ..... 381/17; 381/310

[58] Field of Search ..... 381/17–18, 310, 381/74, 309

[56] References Cited

U.S. PATENT DOCUMENTS

| | | | |
|---|---|---|---|
| 4,700,389 | 10/1987 | Nakayama . | |
| 5,058,081 | 10/1991 | Gulli et al. . | |
| 5,371,799 | 12/1994 | Lowe et al. | 381/25 |
| 5,438,623 | 8/1995 | Begault . | |
| 5,452,359 | 9/1995 | Inanaga et al. | 381/25 |
| 5,500,903 | 3/1996 | Gulli . | |
| 5,659,619 | 8/1997 | Abel | 381/17 |

FOREIGN PATENT DOCUMENTS

| | | |
|---|---|---|
| 0 664 660 | 7/1995 | European Pat. Off. . |
| 2 633 125 | 12/1989 | France . |
| WO 90/07172 | 6/1990 | WIPO . |
| WO 94/01933 | 1/1994 | WIPO . |

OTHER PUBLICATIONS

Begault "3–D Sound for Virtual Reality and Multimedia", pp. 164–174, 207, Jan. 1994.

Begault, 3–D Sound for Virtual Reality and Multimedia, 1994, pp. 18, 221–223, Jan. 1994.

*Primary Examiner*—Vivian Chang

*Attorney, Agent, or Firm*—Oblon, Spivak, McClelland, Maier & Neustadt, P.C.

[57] ABSTRACT

A sound spatialization including, for each monophonic channel to be spatialized, a binaural processor with two paths of convolution filters linearly combined in each path, this processor or these processors being connected to an orienting device for the computation of the spatial localization of the sound sources, the device itself being connected to at least one localizing device. The convolution is done between the monophonic signal and the user's <<left ear>> and <<right ear>> transfer functions, these transfer functions being proper to this user. This improves the efficiency of the system in localizing the monophonic sound source.

4 Claims, 3 Drawing Sheets

SYSTEM OF SOUND SPATIALIZATION AND METHOD PERSONALIZATION FOR THE IMPLEMENTATION THEREOF

BACKGROUND OF THE INVENTION

The present invention relates to a system of sound spatialization as well as to a method of personalization that can be used to implement the sound spatialization system.

An aircraft pilot, especially a fighter aircraft pilot, has a stereophonic helmet that restitutes radiophonic communications as well as various alarms and on-board communications for him. The restitution of radiocommunications may be limited to stereophonic or even monophonic restitution. However, alarms and on-board communications need to be localized in relation to the pilot (or copilot).

SUMMARY OF THE INVENTION

An object of the present invention is a system of audiophonic communication that can be used for the easy discrimination of the localization of a specified sound source, especially when there are several sound sources in the vicinity of the user.

The system of sonar spatialization according to the invention comprises, for each monophonic channel to be spatialized, a binaural processor with two paths of convolution filters linearly combined in each path, this processor or these processors being connected to an orienting device for the computation of the spatial localization of the sound sources, said device itself being connected to localizing devices, wherein the system comprises, for at least one part of the paths, a complementary sound illustration device connected to the corresponding binaural processor, this complementary sound illustration device comprising at least one of the following circuits: a passband broadening circuit, a background noise production circuit, a circuit to simulate the acoustic behavior of a room, a Doppler effect simulation circuit, and a circuit producing different sound symbols each corresponding to a determined source or a determined alarm.

The personalizing method according to the invention consists in estimating the transfer functions of the user's head by the measurement of these functions at a finite number of points of the surrounding space, and then, by the interpolation of the values thus measured, in computing the head transfer functions for each of the user's ears at the point in space at which the sound source is located and in creating the "spatialized" signal on the basis of the monophonic signal to be processed by convoluting it with each of the two transfer functions thus estimated. It is thus possible to "personalize" the convolution filters for each user of the system implementing this method. Each user can then obtain the most efficient possible localization of the virtual sound source restituted by his audiophonic equipment.

BRIEF DESCRIPTION OF THE DRAWINGS

The present invention will be understood more clearly from the detailed description of an exemplary embodiment given by way of a non-restricted example and illustrated by the appended drawings, wherein.

MORE DETAILED DESCRIPTION

Figure 1:
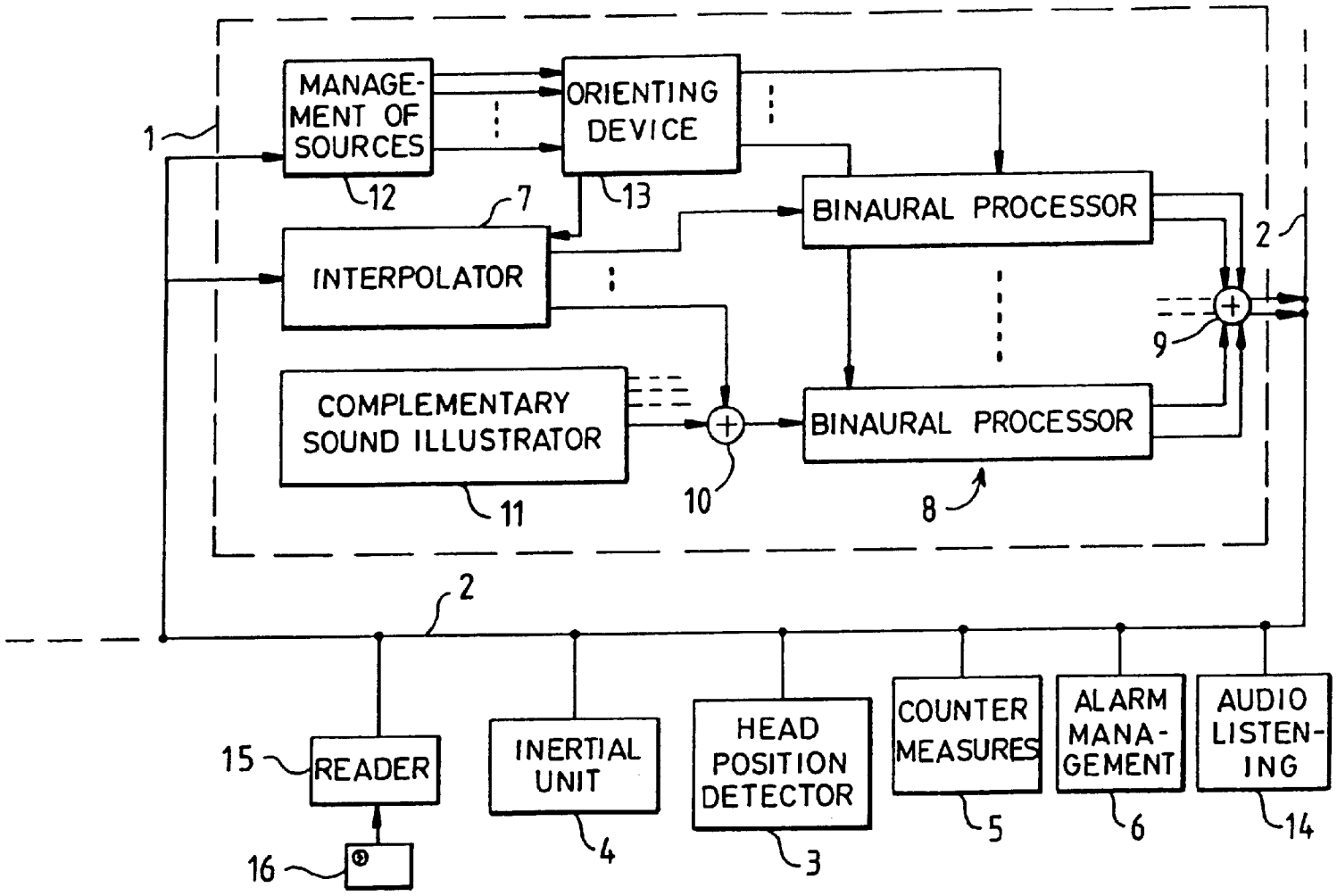
FIG. 1 is a block diagram of a system for sound spatialization according to the invention.

The invention is described here below with reference to an aircraft audiophonic system, especially a combat aircraft, but it is clearly understood that it is not limited to an application of this kind and that it can be implemented in other types of vehicles (land-based or sea vehicles) as well as in fixed installations. The user of this system, in the present case, is the pilot of a combat aircraft but it is clear that there can be several users simultaneously, especially in the case of a civilian transport aircraft, where devices specific to each user will be provided, the number of devices corresponding to the number of users.

The spatialization module 1 shown in the single figure has the role of making the sound signals (tones, speech, alarms, etc.) heard through the stereophonic headphones in such a way that they are perceived by the listener as if they came from a particular point of space. This point may be the actual position of the sound source or else an arbitrary position. Thus, for example, the pilot of an aircraft hears the voice of his copilot as if it is actually coming from behind him. Or again a sound alert of a missile attack is spatially positioned at the point of arrival of the threat. Furthermore, the position of the sound source changes as a function of the motions of the pilot's head and the motions of the aircraft: for example, an alarm generated at the <<3 o'clock>> azimuth must be located at "noon" if the pilot turns his head right by 90°.

The module 1 is for example connected to a digital bus 2 from which it receives information elements given by: a head position detector 3, an inertial unit 4 and/or a localizing device such as a goniometer, radar, etc., counter-measure devices 5 (for the detection of external threats such as missiles) and an alarm management device 6 (providing information in particular on the malfunctioning of instruments or installations of the aircraft).

The module 1 has an interpolator 7 whose input is connected to the bus 2 to which different sound sources (microphones, alarms, etc.) are connected. In general, these sources are sampled at relatively low frequencies (6, 12 or 24 kHz for example). The interpolator 7 is used to raise these frequencies to a common multiple, for example 48 kHz in the present case, which is a frequency necessary for the processors located downline. This interpolator 7 is connected to n binaural processors, all together referenced 8, n being the maximum number of paths to be spatialized simultaneously. The outputs of the processors 8 are connected to an adder 9, the output of which constitutes the output of the module 1. The module 1 also has an adder 10, in the link between at least one output of the interpolator 7 and the input of the processor corresponding to the set of processors 8. The other input of this adder 10 is connected to the input of a complementary sound illustration device 11.

This device 11 produces a sound signal especially covering the high frequencies (for example from 5 to 16 kHz) of the audio spectrum. It thus broadens the useful passband of the transmission channel to which its output signal is added. This transmission channel may advantageously be a radio channel but it is clear that any other channel may be thus broadened and that several channels may be broadened in the same system by providing for a corresponding number of adders such as 10. Indeed, radiocommunications use restricted passbands (3 to 4 kHz in general). A bandwidth of this kind is insufficient for accurate spatialization of the sound signal. Tests have shown that the high frequencies (over about 14 kHz) located beyond the limit of the voice spectrum, enable an improved localization of the source of the sound. The device 11 is then a passband broadening device. The complementary sound signal may for example be a characteristic background noise of a radio link. The device 11 may also be, for example, a device simulating the acoustic behavior of a room, a edifice etc. or a device simulating a Doppler effect or again a device producing different sound symbols each corresponding to a determined source or alarm.

The processors 8 each generate a stereophonic type signal out of the monophonic signal coming from the interpolator 7 to which, if necessary, there is added the signal from the device 11, taking account of the data elements given by the detector 3 of the position of the pilot's head.

The module 1 also has a device 12 for the management of the sources to be spatialized followed by an n-input orienting device 13 (n being defined here above) controlling the n different processors of the set of processors 8. The device 13 is a computer which, on the basis of the data elements given by the detector of the position of the pilot's head, the orientation of the aircraft with respect to the terrestrial reference system (given by the inertial unit of the aircraft) and the localization of the source, computes the spatial coordinates of the point from which the sound given by this source should seem to come from.

If it is sought to simultaneously spatialize n2 distinct sources at n2 distinct points of space (with $n2 \leqq n$), then the device advantageously used as a device 13 will be an orienting device with n2 inputs making sequential computations of the coordinates of each source to be spatialized. Owing to the fact that the number of sound sources that can be distinguished by an average observer is generally four, n2 is advantageously equal to four at most.

At the output of the adder 9, there is obtained a single two-channel (left and right) path that is transmitted through the bus 2 to audio listening circuits 14.

The device 12 for the management of the n sources to be spatialized is a computer which, through the bus 2, receives information elements concerning the characteristics of the sources to be spatialized (elevation, relative bearing and distance from the pilot), criteria for the personalization of the user's choice and priority information (threats, warnings, important radiocommunications, etc.). The device 12 receives information from the device 4 concerning the changes taking place in the localization of certain sources (or of all the sources as the case may be). The device 12 uses this information to select the source (or at most the n2 sources) to be spatialized.

Advantageously, a reader 15 of a memory card 16 for the device 1 is used in order to personalize the management of the sound sources by means of the device 12. The reader 15 is connected to the bus 2. The card 16 then contains the characteristics of the filtering carried out by the auricle of each of the user's ears. In the preferred embodiment, these are the characteristics of a set of pairs of digital filters (namely coefficients representing their pulse responses) corresponding to the "left ear" and "right ear" acoustic filtering operations performed for various points of the space surrounding the user. The database thus formed is loaded, through the bus 2, into the memory associated with the different processors 8.

Each of the processors 8 essentially comprises two filtering paths (called the "left ear" and "right ear" paths) by convolution. More specifically, the role of each of the processors 8 is firstly to carry out the computation, by interpolation, of the head transfer functions (right and left transfer) at the point at which the source will be placed and secondly to create the spatialized signal on two channels on the basis of the original monophonic signal.

The gathering of the head transfer functions dictates a spatial sampling operation: these transfer functions are measured only at a finite number of points (in the range of 100). Now, to "spatialize" a sound accurately, it will be necessary to know the transfer functions at the original point of the source determined by the orienting device 13. It is therefore necessary to accept that the operation must be limited to an estimation of these functions: this operation is performed by a "barycentric" interpolation of the four pairs of functions associated with the four points of measurement closest to the point in space computed.

Figure 2:
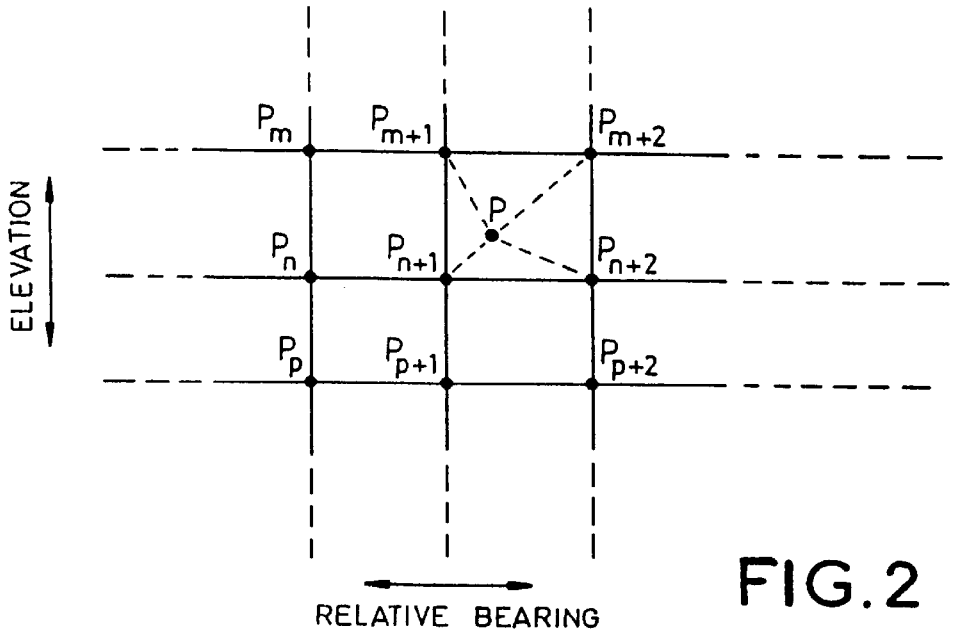
FIG. 2 is a diagram explaining the spatial interpolation achieved according to the method of the invention.

Thus, as can be seen schematically in FIG. 2, measurements are made at different points of the space evenly distributed in relative bearing and in elevation and located on one and the same sphere. FIG. 2 shows a part of the "grid" G thus obtained for the points Pm, Pm+1, Pm+2, . . . , Pp, Pp+1, . . . . Let us take a point P of said sphere, determined by the orienting device 13 as being located in the direction of the sound source to be "spatialized". This point P is within the curvilinear quadrilateral demarcated by the points Pm+1, Pm+2, Pn+1, Pn+2. The barycentric interpolation is therefore performed for the position of P with respect to these four points. The different instruments determining the orientation of the sound source and the orientation and location of the user's head give their respective data every 20 or 40 ms ($\Delta T$), namely every $\Delta T$, a pair of transfer functions is available. In order to avoid audible "jumps" during the restitution (when the operator modifies the orientation of his head he must perceive a sound without interruption), the signal to be spatialized is actually convoluted by a pair of filters obtained by "temporal" interpolation performed between the convolution filters spatially interpolated at the instants T and $T+\Delta T$. All that remains to be done then is to convert the digital signals thus obtained into analog signals before restoring them in the user's headphones.

Figure 3:
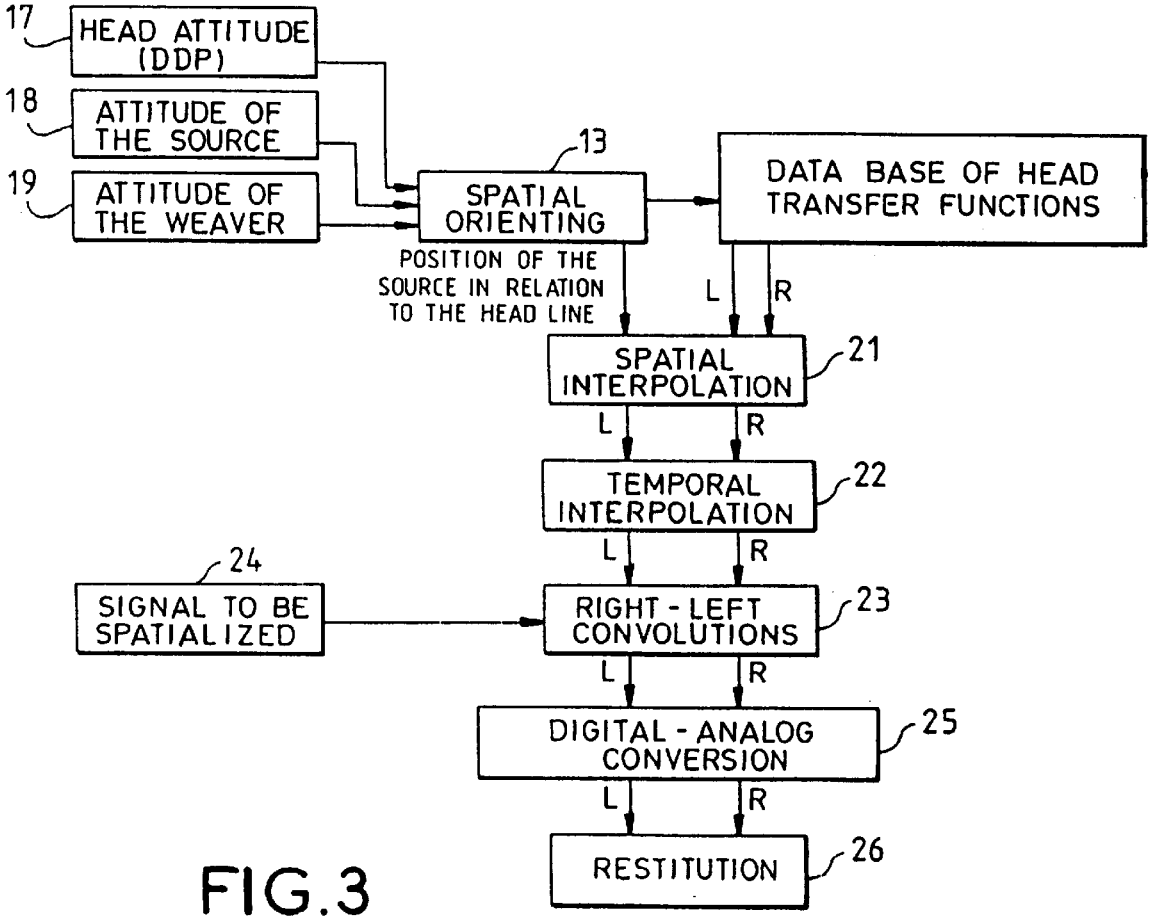
FIG. 3 is a functional block diagram of the main spatialization circuits of the invention.

The diagram of FIG. 3, which pertains to a path to be spatialized, shows the different attitude (position) sensors implemented. These are: a head attitude sensor 17, a sound source attitude sensor 18 and a mobile carrier (for example aircraft) attitude sensor 19. The information from these sensors is given to the orienting device 13 which uses this information to determine the spatial position of the source with respect to the user's head (in terms of line of aim and distance). The orienting device 13 is connected to a database 20 (included in the card 16) for which it controls the loading into the processors 8 of the "left" and "right" transfer functions of the four points closest to the position of the source (see FIG. 2) or, as the case may be, the four points closest to the point of measurement (if the position of the source coincides with that of one of the points of measurement of the grid G). These transfer functions are subjected to a spatial interpolation at 21 and then a temporal interpolation at 22 and the resultant values are convoluted at 23 with the signal 24 to be spatialized. Naturally, the functions 21 and 22 are achieved by the same interpolator (interpolator 7 of FIG. 1) and the convolutions are achieved by the binaural processor 8 corresponding to the spatialized path. After convolution, a digital-analog conversion is performed at 25 and the sound restitution (amplification and sending to a stereophonic headphone) is carried out at 26. Naturally, the operations 20 to 23 and 25, 26 are done separately for the left path and for the right path.

Figure 4:
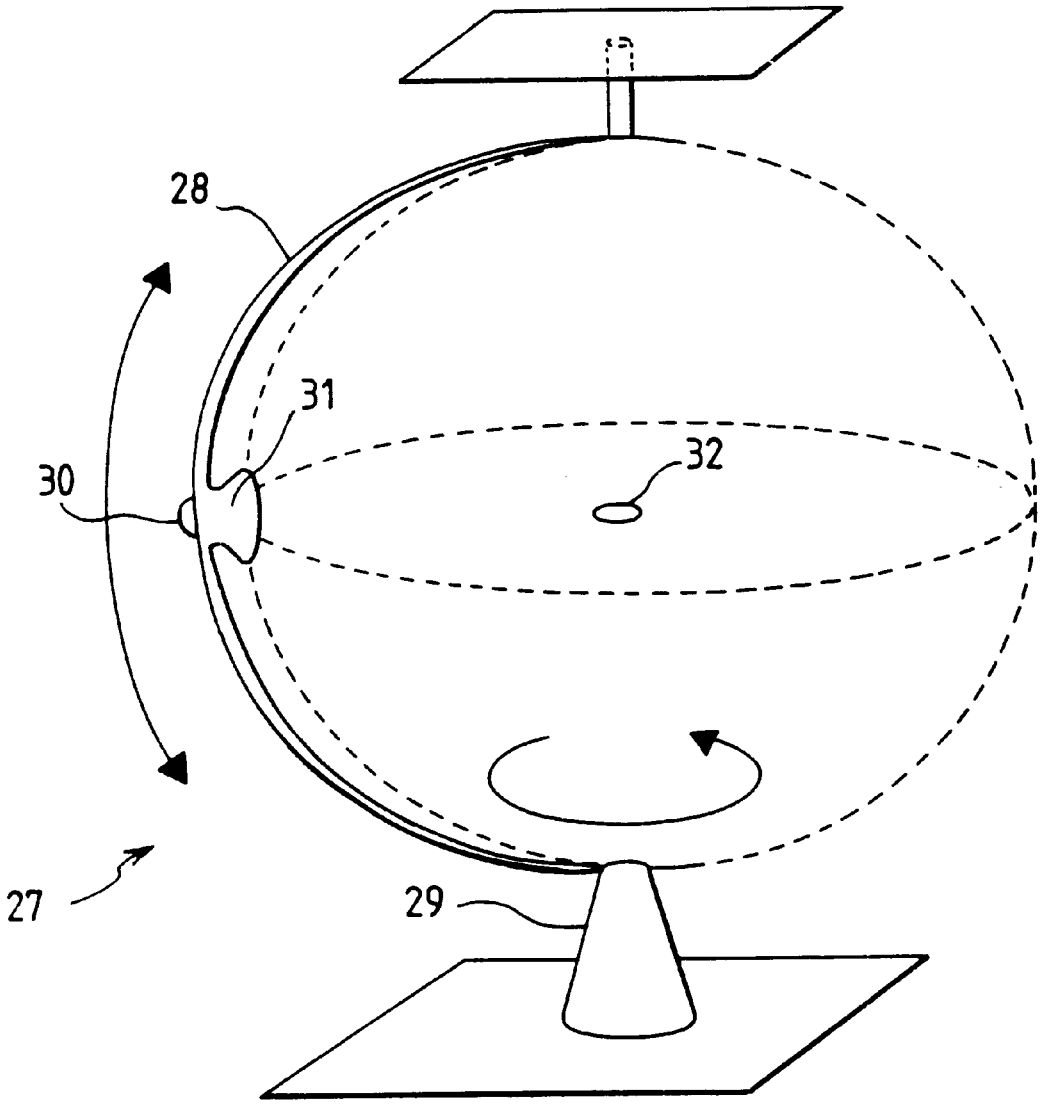
FIG. 4 is a simplified view of the instrument for collecting the head transfer functions according to the method of the invention.

The <<personalized>> convolution filters forming the database referred to here above are prepared on the basis of measurements making use of a method described here below with reference to FIG. 4.

In an anechoic chamber, an automated mechanical tooling assembly 27 is installed. This tooling assembly consists of a semicircular rail 28 mounted on a motor-driven pivot 29 fixed to the ground of this chamber. The rail 28 is positioned vertically so that its ends are on the same perpendicular. A support 30 shifts on this rail 28. A broadband loudspeaker 31 is mounted on this support 30. This device enables the loudspeaker to be placed at any point of the sphere defined by the rail when this rail performs a 360° rotation about a vertical axis passing through the pivot 29. The precision with which the loudspeaker is positioned is equal to one degree in elevation and in relative bearing for example.

A first series of readings is taken. The loudspeaker 31 is placed successively at X points of the sphere, that is the space is <<discretized>>. This is a spatial sampling operation. At each measurement point, a pseudo-random code is generated and restituted by the loudspeaker 31. The sound signal emitted is picked up by a pair of reference microphones placed at the center 32 of this sphere (the distance between the microphones is in the range of the width of the head of the subject whose transfer functions are to be collected) in order to measure the resultant acoustic pressure as a function of the frequency.

A second series of reading is then taken: the method is the same but this time the subject is positioned in such a way that his ears are located at the position of the microphones (the subject controls the position of his head by video feedback). The subject is provided with individualized earplugs in which miniature microphones are placed. The full plugging of the ear canal has the following advantages: the ear is acoustically protected and the stapedial reflex (which is non-existent in this case) does not modify the acoustical impedance of the assembly.

For each position of the loudspeaker, for each ear, after compensation for the responses of the miniature microphones and of the loudspeaker, the ratio of the acoustical pressures is computed as a function of frequency, measured in the two previous experiments. Thus X pairs (left ear, right ear) of transfer functions are obtained.

Depending on the technique of convolution used, the database of the transfer functions may be formed either by pairs of frequency responses (convolution by multiplication in the frequency domain) or by pairs of pulse responses (standard temporal convolution). The pulse responses are reverse Fourier transforms of the frequency responses.

The use of a signal obtained by the generation of a pseudo-random binary code provides a pulse response with a wide dynamic range with a level of emitted sound having an average value (70 dBa for example).

The use of sound sources that emit pseudo-random binary signals is tending to become widespread in the technique of pulse response measurement, especially for the characterizing of an acoustic room by the correlation method.

Apart from their characteristics (self-correlation function) and their special properties which lend themselves to optimization (using the Hadamard transform), these signals make the hypothesis of linearity of the acoustic collecting system acceptable. They also make it possible to overcome the effects of the variations in acoustic impedance in the bone structure of the middle ear through stapedial reflex, by limiting the level of initial emission (70 dBa). Preferably, pseudo-random binary signals are produced with sequences of maximum length. The advantage of sequences with maximum length lies in their spectral characteristics (white noise) and their mode of generation which enables an optimization of the processor.

The principles of measurement using pseudo-random binary signals implemented by the present invention are described for example in the following works:

J. K. Holmes: "Coherent spread-spectrum systems", Wiky Interscience.

J. Borish and J. B. Angell: "An efficient algorithm for measuring the impulse response pseudo-random noise", J. Audio Eng. Soc., Vol. 31, No. 7, July/August 1983.

Otshudi, J. P. Quilhot: "Considérations sur les propriétés énergétiques des signaux binaires pseudo-aléatoires et sur leur utilisation comme excitateurs acoustiques" (Considerations on the energy properties of pseudo-random binary signals and their use as acoustic exciters), Acustica, Vol. 90, pp. 76–81, 1990.

They are only briefly recalled herein.

On the basis of the generation of pseudo-random sequences, the following main functions are performed:

the generation of a reference signal and the concomitant recording of the two microphone paths, the computation of the pulse response of the acoustic trajectory (diffraction), the computation of certain criteria (the gain of each path, the rank of the average-taking operation, the digital output level, storage indicator, the measurement of the binaural delay of the two paths by correlation, shifting to simulate geometrical delays, etc.), the display of the results, echograms, decay, print-out.

The pulse response is obtained for the period $(2n-1)/fe$ where n is the order of the sequence and where fe is the sampling frequency. It is up to the experimenter to choose a pair of values (the order of the sequence fe) that is sufficient to have the entire useful decay of the response.

The sound spatializing device described here above can be used to increase the intelligibility of the sound sources that it processes, reduce the operator's reaction time with respect to alarm signals, warnings or other sound indicators, the sources of which appear to be located respectively at different points in space making it easier to discriminate between them and easier to classify them by order of importance or urgency.

What is claimed is:

1. A system for the spatialization of sound sources comprising:

a plurality of monophonic sound sources configured to output a plurality of source signals;

an interpolator configured to at least 1) receive said plurality of source signals, 2) raising said plurality of source signals to a predetermined common frequency, said common frequency being a common multiple of frequencies of said plurality of source signals, and 3) output at least one interpolated signal;

an orienting device for spatial localization of each of said monophonic sound sources;

at least one localization device connected to said orienting device;

a complementary sound illustration device outputting a complementary signal;

a binaural processor having at least two paths of linearly combined convolution filters wherein at least one path of said binaural processor receives a signal combining both the complementary signal and the interpolated signal;

said orienting device connected to said binaural processor; and a data storage device configured to store personalized data of a specific user characteristic of filtering performed by auricles of the specific user's ears, the data being provided to said binaural processor.

2. A system according to claim 1, wherein the localization device is at least one of the following devices: inertial unit, head position detector, radar and goniometer.

3. A system according to claim 1, connected to a countermeasures device.

4. A system for the spatialization of sound sources according to claim 1, wherein said complementary sound illustration device is one of: a passband broadening circuit; a background noise production circuit; a circuit to simulate the acoustic behavior of a room; a Doppler effect simulation circuit; and a circuit for producing different sound symbols each corresponding to a determined source or a determined alarm.

* * * * *

UNITED STATES PATENT AND TRADEMARK OFFICE

CERTIFICATE OF CORRECTION

PATENT NO. : 5,987,142

DATED : November 16, 1999

INVENTOR(S): Maîté COURNEAU, et al

It is certified that an error appears in the above-identified patent and that said Letters Patent is hereby corrected as shown below:

On the title page, item [45] should be:

-- [45] **Date of Patent: *Nov. 16, 1999** --

On the title page, item [75], the 2nd Inventor's city should be:

-- Casteluau de Médoc --

On the title page, the Continued Prosecution Application information has been omitted. It should read as follows:

-- [*] Notice: This patent issued on a continued prosecution application filed under 37 CFR 1.53(d), and is subject to the twenty year patent term provisions of 35 U.S.C. 154(a)(2). --

Signed and Sealed this

Fifth Day of December, 2000

*Attest:*

*Attesting Officer*

Q. TODD DICKINSON

*Director of Patents and Trademarks*